US010934984B1

(12) United States Patent
Roseborsky et al.

(10) Patent No.: US 10,934,984 B1
(45) Date of Patent: Mar. 2, 2021

(54) FUEL DELIVERY SYSTEM

(71) Applicants: DENSO International America, Inc., Southfield, MI (US); Denso Corporation, Kariya (JP)

(72) Inventors: Steve Roseborsky, Canada (CA); Garrett Stewart, Fenton, MI (US)

(73) Assignees: DENSO International America, Inc., Southfield, MI (US); DENSO Corporation, Kariya (JP)

( * ) Notice: Subject to any disclaimer, the term of this patent is extended or adjusted under 35 U.S.C. 154(b) by 0 days.

(21) Appl. No.: 16/552,187

(22) Filed: Aug. 27, 2019

(51) Int. Cl.
*F02M 51/00* (2006.01)
*F02M 55/02* (2006.01)
*F02M 61/14* (2006.01)

(52) U.S. Cl.
CPC ..... *F02M 51/005* (2013.01); *F02M 55/025* (2013.01); *F02M 61/14* (2013.01); *F02M 2200/852* (2013.01); *F02M 2200/853* (2013.01); *F02M 2200/856* (2013.01)

(58) Field of Classification Search
CPC .... F02M 51/00; F02M 51/005; F02M 55/025; F02M 61/14; F02M 2200/852; F02M 2200/853; F02M 2200/856
See application file for complete search history.

(56) References Cited

U.S. PATENT DOCUMENTS 7,467,618 B2 * 12/2008 Zdroik ..... F02M 55/005 123/470

FOREIGN PATENT DOCUMENTS

EP 3508716 A1 * 7/2019 ..... F02M 61/14

* cited by examiner

*Primary Examiner* — Hieu T Vo
(74) *Attorney, Agent, or Firm* — Brooks Kushman P.C.

(57) ABSTRACT

A fuel delivery system for an engine includes a fuel rail, a fuel injector, and a clip. The fuel rail has a cup that defines an opening. The fuel injector has an upper end that is disposed within the opening such that the cup and fuel injector are axially aligned. The clip is secured to the fuel injector and engages the cup to orient the fuel injector radially relative to the cup. The clip has a tab that extends outward relative to the fuel injector. The tab defines a central orifice that is configured to receive a fastener. The fastener is configured to mount a wire harness.

18 Claims, 1 Drawing Sheet

FUEL DELIVERY SYSTEM

TECHNICAL FIELD

The present disclosure relates to fuel delivery systems for internal combustion engines.

BACKGROUND

Internal combustion engines include fuel delivery systems that are configured to transport fuel from a storage container, such as a fuel tank, to the individual cylinders of the internal combustion engine.

SUMMARY

A fuel delivery system for an engine includes a fuel rail, a fuel injector, and a clip. The fuel rail has a cup that defines an opening. The fuel injector has an upper end that is disposed within the opening such that the cup and fuel injector are axially aligned. The clip is secured to the fuel injector and engages the cup to orient the fuel injector radially relative to the cup. The clip has a tab that extends outward relative to the fuel injector. The tab defines a central orifice that is configured to receive a fastener. The fastener is configured to mount a wire harness.

A fuel delivery system for an engine includes a fuel injector and a clip. The fuel injector is configured to engage a fuel rail cup. The clip is secured to the fuel injector and is configured to engage the fuel rail cup to prevent relative rotation between the fuel injector and the fuel rail cup. The clip has a tab that extends outward relative to the fuel injector. The tab is configured to receive a fastener. The fastener is configured to mount a wire harness.

A clip that is configured to secure a wire harness to a fuel injector and that is configured to orient the fuel injector radially relative to a fuel rail cup includes a central body, a prong, and a tab. The central body defines a slot that is configured to engage the fuel injector to secure the clip to the fuel injector. The prong extends upward from the central body. The prong is configured to engage the fuel rail cup to orient the fuel injector radially relative to the fuel rail cup. The tab extends outward from the central body. The tab defines a central orifice that is configured to receive a fastener for mounting a wire harness.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
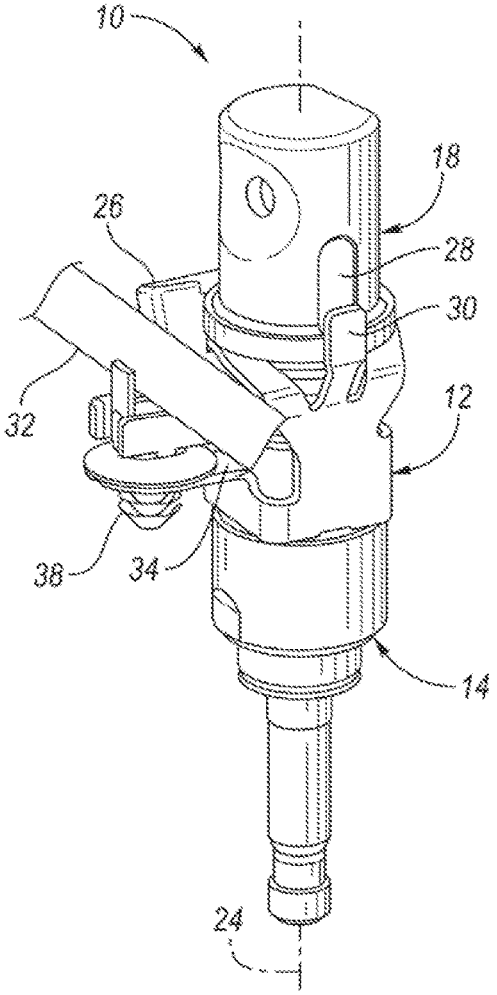
FIG. 1 is a rear isometric view of a fuel delivery system that includes a fuel rail cup and at least one fuel injector.
Figure 2:
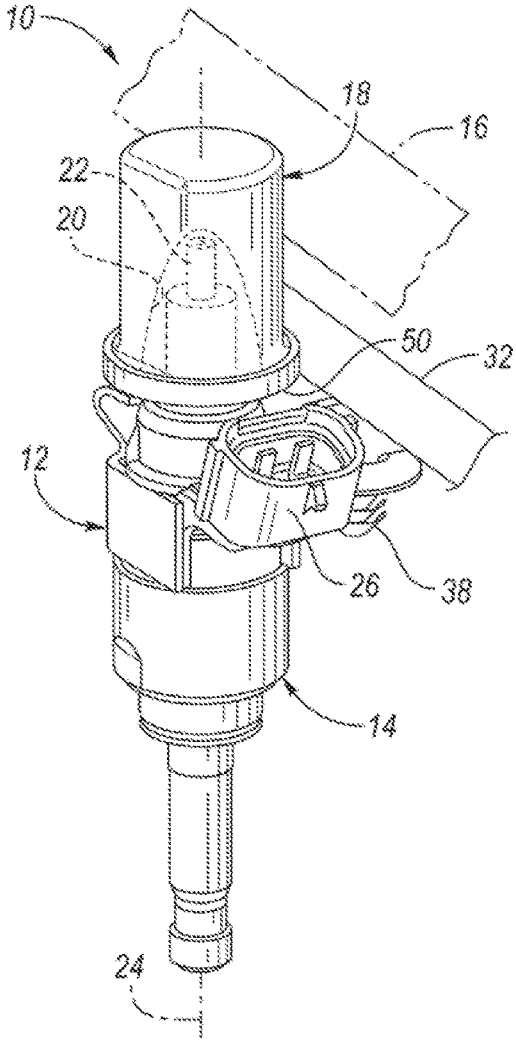
FIG. 2 is a front isometric view of the fuel delivery system that includes the fuel rail cup, the at least one fuel injector, and a portion of the fuel rail.
Figure 3:
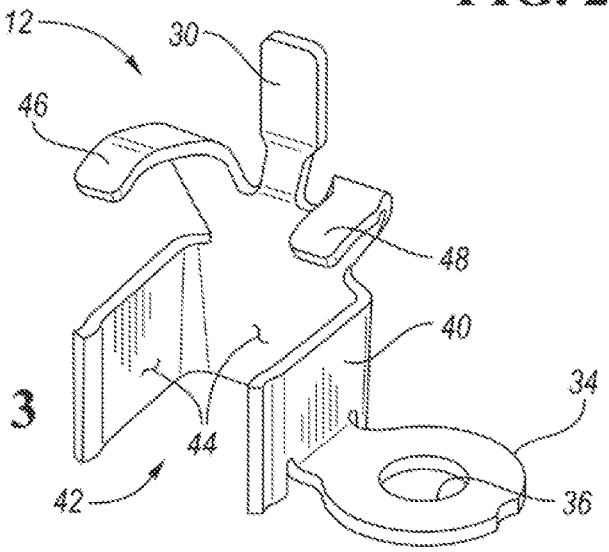
FIG. 3 is an isometric view of a clip that is configured to orient the fuel injector radially relative to a fuel rail cup and that is configured to secure a wire harness to the fuel injector.

Referring to FIGS. 1-3, a fuel delivery system 10 and a clip 12 that is configured to engage a fuel injector 14 are illustrated. More specifically, the fuel delivery system 10, which includes the clip 12, is illustrated in FIGS. 1 and 2 while the clip 12 alone is illustrated in FIG. 3. The fuel delivery system 10 may be configured to deliver fuel to an internal combustion engine. More specifically, the fuel delivery system 10 may be configured to deliver fuel to an internal combustion engine in a vehicle or automobile.

The fuel delivery system 10 includes a fuel rail 16. The fuel rail 16 is configured to deliver fuel to the individual cylinders of the internal combustion engine. The fuel rail 16 may be a straight pipe or tube in the event the internal combustion engine has inline cylinders (e.g., a straight four-cylinder engine or a straight six-cylinder engine). Alternatively, the fuel rail 16 may be a pipe or tube that is U-shaped in the event the internal combustion engine is V-shaped (e.g., a V-6 or V-8 engine). It should be noted that only a fragmented portion of the fuel rail 16 is illustrated in FIG. 2 and that the fuel rail 16 is illustrated in phantom lines for illustrative purposes. Furthermore, it should be noted that only a single connection between the fuel rail 16 and one of the fuel injectors 14 is illustrated in FIG. 2, and that the fuel rail 16 may be connected to a plurality of fuel injectors 14 depending on the number of cylinders of the internal combustion engine.

The fuel rail 16 may include a fuel rail cup 18 that defines an opening 20 that is configured to receive an upper end 22 of the fuel injector 14. Stated in other terms, the fuel injector 14 may be configured to engage the fuel rail cup 18 such that the upper end 22 of the fuel injector 14 is disposed within the opening 20 and such that the fuel rail cup 18 and the fuel injector 14 are axially aligned along a vertical axis or a longitudinal axis 24. In an embodiment that includes several fuel injectors 14, the fuel rail 16 may include several fuel rail cups 18 that each define an opening 20 that is configured to receive an upper end 22 of one of the fuel injectors 14. The fuel injector 14 may include an electrical receptacle 26 that protrudes outward from the fuel injector 14. More specifically, the electrical receptacle 26 may protrude radially outward from the fuel injector 14. The electrical receptacle 26 of the fuel injector 14 may connect the fuel injector 14 to an external power source and an external controller that is configured to operate an electrical solenoid within the fuel injector 14 in order to open and close the fuel injector 14 for the purposes of delivering fuel to the respective cylinder of the internal combustion engine that the fuel injector 14 is configured to deliver fuel to.

The clip 12 is secured to the fuel injector 14. The clip 12 is configured to engage the fuel rail cup 18 to orient the fuel injector 14 radially relative to the fuel rail cup 18 and to prevent relative rotation between the fuel injector 14 and the fuel rail cup 18 about the longitudinal axis 24. More specifically, an exterior surface of the fuel rail cup 18 defines a notch 28 and the clip 12 engages the notch 28 to orient the fuel injector 14 radially relative to the fuel rail cup 18 and to prevent relative rotation between the fuel injector 14 and the fuel rail cup 18 about the longitudinal axis 24. Specifically, the clip 12 may have a first prong 30 that extends upward and/or axially (i.e., along the longitudinal axis 24 or substantially parallel to the longitudinal axis 24) from the fuel injector 14 to the fuel rail cup 18 that engages the notch 28 to orient the fuel injector 14 radially relative to the fuel rail cup 18 and to prevent relative rotation between the fuel injector 14 and the fuel rail cup 18 about the longitudinal axis 24. Substantially parallel may include any incremental value that ranges between exactly parallel and 15° from exactly parallel.

The clip 12 may also be configured to secure a wire harness 32 to the fuel injector 14. The clip 12 has a tab 34 that extends outward relative to the fuel injector 14. More specifically, the tab 34 may extend radially outward relative to the fuel injector 14. The tab 34 defines a central orifice 36 that is configured to receive a fastening device or fastener 38. The fastener 38 in turn is configured to mount the wire harness 32 to the fuel injector 14 via the clip 12. The fastener 38 may be a bolt, bolt/nut combination, rivet, screw, clip, etc. In some instances, the central orifice 36 may be a tapped hole that engages the fastener 38 if the fastener 38 is a bolt or screw. More specifically, the fastener 38 may be a Christmas tree rivet that engages the central orifice 32 defined by the tab 34 to secure the wire harness 32 to the clip 12. The rivet 38 may be secured to the wire harness 32 via a cable tie or zip tie connection. The cable tie or zip tie connection may include a flexible tape section having teeth that extends from the wire harness 32 and engages a pawl that is on the head of the rivet 38 to form a ratcheting connection between the wire harness 32 and the rivet 38. It should be noted that only a fragmented portion of the wire harness 32 is illustrated in FIGS. 1 and 2 for illustrative purposes.

The wire harness 32 may include the electrical wires and electrical plug that connect the fuel injector 14 via the electrical receptacle 26 to the external power source and the external controller that is configured to operate an electrical solenoid within the fuel injector 14. More specifically, the wire harness 32 may include several electrical wires and electrical plugs that connect several fuel injectors, which have the same configuration as the illustrated fuel injector 14, to the external power source and the external controller, which is configured to operate electrical solenoids within the several fuel injectors. In such an embodiment that includes several fuel injectors, a clip 12 may be secured to each fuel injector 14 such that the wire harness 32 is anchored at several locations where each anchoring location is relatively close to each fuel injector 14 via a fastener 38 and tab 34 connection. Anchoring the wire harness 32 at locations that are close to each fuel injector 14 will assist in preventing the plugs of the wire harness 32 from disconnecting from their respective electrical receptacles 26 when an external force is applied to the wire harness 32 during manufacturing or during servicing of the engine or vehicle or during regular vehicle operation.

The tab 34 and the electrical receptacle 26 may be oriented at a substantially perpendicular angle relative to each other along a plane that is substantially perpendicular to the longitudinal axis 24. Substantially perpendicular may include any incremental value that ranges between exactly perpendicular and 15° from exactly perpendicular. The tab 34 may also be disposed below and spaced apart from the fuel rail 16 and the fuel rail cup 18. Specifically, such an arrangement decouples the tab 34 and hence the wire harness 32 from the fuel rail 16 itself, which in turn decreases the number of components of the fuel rail 16 and simplifies the manufacturing process of the fuel rail 16.

The clip 12 includes a central body 40. The tab 34 may protrude outward from a lower portion of the central body 40 as shown in FIG. 3, may protrude outward from an upper portion of the central body 40 as shown in FIG. 1, or may protrude outward from any position of the central body 40 between the upper and lower portions of the central body 40. The central body 40 defines a slot 42 that is configured to engage the fuel injector 14 in order to secure the clip 12 to the fuel injector 14. The engagement between the clip 12 and the fuel injector 14 may be a keyed engagement that prevents relative rotation between the clip 12 and the fuel injector 14 about the longitudinal axis 24. For example, the clip 12 may include flat interior surfaces 44 while the fuel injector 14 may include flat exterior surfaces. Engagement between the flat interior surface 44 of the clip 12 and the flat exterior surfaces of the fuel injector 14 act to prevent relative rotation between the clip 12 and the fuel injector 14 about the longitudinal axis 24. Stated in other terms, the slot 42 and the exterior surface of the fuel injector 14 that is engaged by the central body 40 of the clip 12 via the slot 42 may have noncircular shapes that form the keyed engagement to prevent relative rotation between the clip 12 and the fuel injector 14 about the longitudinal axis 24. For example, the slot 42 and the exterior surface of the fuel injector 14 that is engaged by the central body 40 of the clip 12 may be rectangular in shape.

The clip 12 may have a second prong 46 and a third prong 48 that straddle the first prong 30. The second prong 46 and the third prong 48 may engage a lower surface 50 of the fuel rail cup 18. The second prong 46 and the third prong 48 may be configured to generate a biasing force on the fuel rail cup 18 to absorb combustion energy that is translated to the fuel injector 14 during combustion within the engine.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A fuel delivery system for an engine comprising:

a fuel rail having a cup that defines an opening;

a fuel injector having an upper end that is disposed within the opening such that the cup and fuel injector are axially aligned;

a clip secured to the fuel injector and engaging the cup to orient the fuel injector radially relative to the cup, the clip having a tab that extends outward relative to the fuel injector, the tab defining a central orifice configured to receive a fastener configured to mount a wire harness; and a wire harness having a fastening device that engages the central orifice to secure the wire harness to the clip.

2. The fuel delivery system of claim 1, wherein the fuel injector includes an electrical receptacle that protrudes outward from the fuel injector.

3. The fuel delivery system of claim 2, wherein the electrical receptacle is substantially perpendicular to the tab.

4. The fuel delivery system of claim 1, wherein the tab is disposed below and spaced apart from the fuel rail.

5. The fuel delivery system of claim 1, wherein an exterior surface of the cup defines a notch and the clip engages the notch to orient the fuel injector radially relative to the cup.

6. The fuel delivery system of claim 5, wherein the clip has a first prong that extends axially from the fuel injector to the cup and engages the notch to orient the fuel injector radially relative to the cup.

7. The fuel delivery system of claim 6, wherein clip has second and third prongs that straddle the first prong and engage a lower surface of the cup.

8. The fuel delivery system of claim 1, wherein the clip is secured to the fuel injector via a keyed engagement to prevent relative rotation between the clip and fuel injector.

9. A fuel delivery system for an engine comprising:

a fuel injector configured to engage a fuel rail cup; and a clip secured to the fuel injector and configured to engage the fuel rail cup to prevent relative rotation between the fuel injector and the fuel rail cup, the clip having a tab that extends outward relative to the fuel injector, wherein the tab is configured to receive a fastener that is configured to mount a wire harness, and wherein the tab is disposed below and spaced apart from the fuel rail cup.

10. The fuel delivery system of claim 9, wherein the tab defines a central orifice, and wherein the fuel delivery system further comprises a wire harness having a fastening device that engages the central orifice to secure the wire harness to the clip.

11. The fuel delivery system of claim 9, wherein the fuel injector includes an electrical receptacle that protrudes outward from the fuel injector.

12. The fuel delivery system of claim 11, wherein the electrical receptacle is substantially perpendicular to the tab.

13. The fuel delivery system of claim 9, wherein the clip engages a notch defined on an exterior of the fuel rail cup to orient the fuel injector radially relative to the cup.

14. The fuel delivery system of claim 13, wherein the clip has a first prong that extends upward from the fuel injector to the cup and engages the notch to orient the fuel injector radially relative to the cup.

15. The fuel delivery system of claim 14, wherein clip has second and third prongs that straddle the first prong and engage a lower surface of the cup, wherein the second and third prongs are configured to generate a biasing force on the cup to absorb combustion energy that is translated to the fuel injector.

16. The fuel delivery system of claim 9, wherein the clip is secured to the fuel injector via a keyed engagement to prevent relative rotation between the clip and fuel injector.

17. A clip configured to secure a wire harness to a fuel injector and to orient the fuel injector radially relative to a fuel rail cup comprising:

a central body defining a slot that is configured to engage the fuel injector to secure the clip to the fuel injector;

a prong extending upward from the central body and configured to engage the fuel rail cup to orient the fuel injector radially relative to the fuel rail cup; and a tab that extends outward from the central body, the tab defining a central orifice that is configured to receive a fastener for mounting a wire harness.

18. The clip of claim 17 further comprising second and third prongs that straddle the first prong, wherein the first and second prongs are configured to engage a lower surface of the cup and to generate a biasing force on the cup to absorb combustion energy that is translated to the fuel injector.

* * * * *